US008784289B2

(12) United States Patent
Greco et al.

(10) Patent No.: US 8,784,289 B2
(45) Date of Patent: Jul. 22, 2014

(54) PROCESS OF FORMING A WIDE MOUTH GUSSETED BAG WITH EDGE SEALS

(75) Inventors: Charles Greco, Bardonia, NY (US); David Matthews, Gilman, IL (US); David Anzini, Middletown, NY (US); Eric Plourde, Frankfort, IL (US); Kenny McCracken, Dacula, GA (US)

(73) Assignee: Illinois Tool Works Inc., Glenview, IL (US)

( * ) Notice: Subject to any disclaimer, the term of this patent is extended or adjusted under 35 U.S.C. 154(b) by 728 days.

(21) Appl. No.: 13/036,378

(22) Filed: Feb. 28, 2011

(65) Prior Publication Data

US 2012/0047852 A1 Mar. 1, 2012

Related U.S. Application Data

(60) Provisional application No. 61/329,400, filed on Apr. 29, 2010.

(51) Int. Cl.

| | |
|---|---|
| ***B31B 1/90*** | (2006.01) |
| ***B65B 61/18*** | (2006.01) |
| ***B31B 19/90*** | (2006.01) |

(52) U.S. Cl.

CPC . *B31B 1/90* (2013.01); *B31B 19/90* (2013.01); *B31B 2219/23* (2013.01); *B31B 2219/9022* (2013.01); *B65B 61/188* (2013.01); *Y10S 493/927* (2013.01)

USPC ..... 493/213; 53/412; 493/927

(58) Field of Classification Search

CPC ..... B31B 1/90; B31B 19/90; B31B 2219/23; B31B 2219/9016; B31B 2219/9019; B31B 2219/9022; B65B 61/188; B65B 2220/08; B65B 2220/12

USPC ..... 53/412, 133.3, 133.4, 139.2; 493/213, 493/214, 927

See application file for complete search history.

(56) References Cited

U.S. PATENT DOCUMENTS

| | | | | |
|---|---|---|---|---|
| 4,878,987 | A * | 11/1989 | Ven Erden | 493/213 |
| 5,275,491 | A * | 1/1994 | Kuge et al. | 53/412 |
| 5,826,401 | A * | 10/1998 | Bois | 53/412 |
| 6,428,456 | B1 * | 8/2002 | Visona' et al. | 493/133 |
| 6,481,183 | B1 * | 11/2002 | Schmidt | 53/412 |
| 6,513,308 | B1 * | 2/2003 | Meeuwesen et al. | 53/551 |
| 6,729,112 | B2 * | 5/2004 | Kuss et al. | 53/551 |
| 6,796,932 | B2 * | 9/2004 | Kuge et al. | 493/218 |
| 6,820,391 | B2 * | 11/2004 | Barmore et al. | 53/133.4 |

(Continued)

FOREIGN PATENT DOCUMENTS

| | | |
|---|---|---|
| DE | 101 21 526 | 11/2002 |
| EP | 1 607 340 | 12/2005 |

(Continued)

*Primary Examiner* — Stephen F Gerrity

(74) *Attorney, Agent, or Firm* — McCarter & English, LLP

(57) ABSTRACT

The embodiments include a wide mouth gusseted package wherein four machine direction edge seals are formed on the film, and the zipper is applied in the transverse direction on the opposite side of the film from where the machine direction edge seals are formed. In the resulting package, the edge seals are at the exterior of the four corners of the package, and the resulting gussets can be folded inwardly or outwardly. The package may further include a sealing strip with a peel seal layer and a sealant layer whereby a hermetic package may be produced at higher production rates and lower productions costs.

19 Claims, 5 Drawing Sheets

(56) References Cited

U.S. PATENT DOCUMENTS

| | | | | |
|---|---|---|---|---|
| 2001/0022866 | A1* | 9/2001 | Beer | 383/211 |
| 2002/0103067 | A1* | 8/2002 | Bois | 493/394 |
| 2003/0063820 | A1* | 4/2003 | Buchman | 383/63 |
| 2004/0014576 | A1* | 1/2004 | Bois | 493/114 |
| 2004/0154271 | A1* | 8/2004 | Rietjens | 53/451 |
| 2005/0014623 | A1* | 1/2005 | Van De Kruys et al. | 493/162 |
| 2005/0113233 | A1* | 5/2005 | Ferfolja et al. | 493/165 |
| 2007/0258665 | A1* | 11/2007 | Greco et al. | 383/63 |
| 2008/0037909 | A1* | 2/2008 | Leighton | 383/61.3 |
| 2008/0085823 | A1* | 4/2008 | Reggi | 493/189 |
| 2008/0205801 | A1* | 8/2008 | Alaux | 383/120 |
| 2009/0028472 | A1* | 1/2009 | Andersson et al. | 53/133.4 |
| 2010/0014790 | A1* | 1/2010 | Colla | 383/120 |
| 2010/0069212 | A1* | 3/2010 | Chaturvedi | 493/214 |
| 2010/0323868 | A1* | 12/2010 | Miyamoto et al. | 493/243 |

FOREIGN PATENT DOCUMENTS

| | | | | |
|---|---|---|---|---|
| EP | 1873081 | A1 * | 1/2008 | B31B 19/36 |
| GB | 2354969 | A * | 4/2001 | B31B 1/26 |
| WO | WO 0124999 | A1 * | 4/2001 | B31B 19/74 |
| WO | 01/54998 | | 8/2001 | |

* cited by examiner

FIG. 4
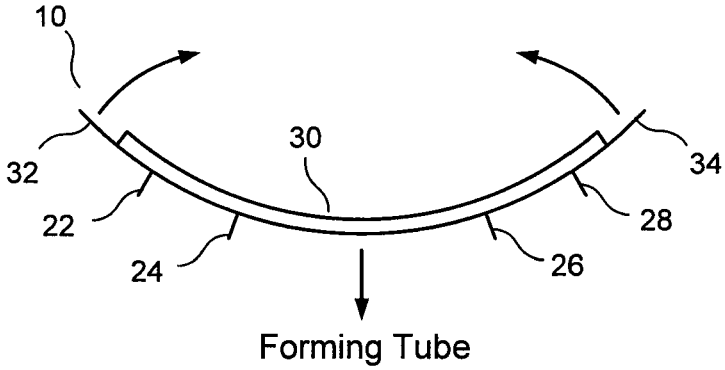
FIG. 5
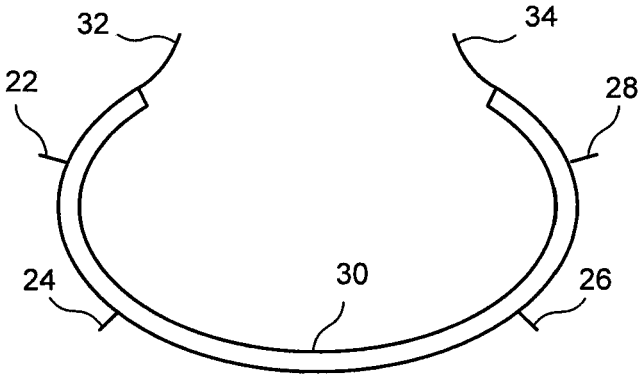
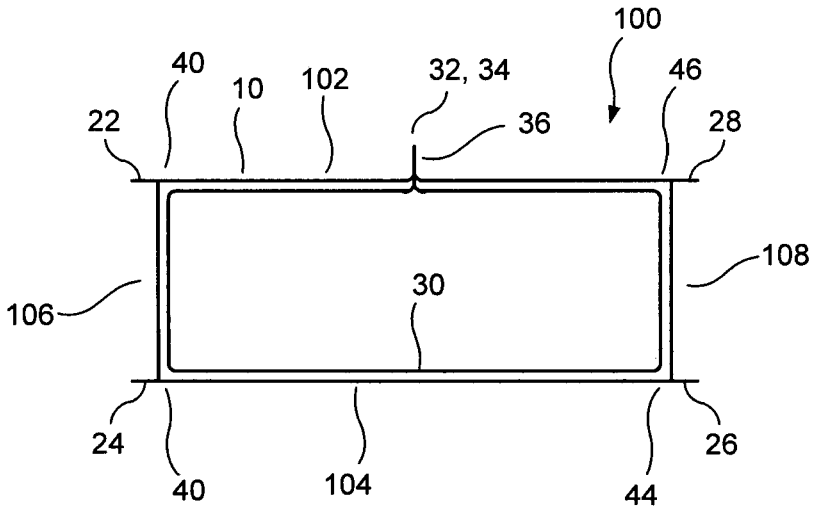
FIG. 6

PROCESS OF FORMING A WIDE MOUTH GUSSETED BAG WITH EDGE SEALS

This application claims priority under 35 U.S.C. §119(e) of U.S. provisional application Ser. No. 61/329,400 filed Apr. 29, 2010, the disclosure of which is hereby incorporated by reference in its entirety.

BACKGROUND OF THE DISCLOSURE

1. Field of the Disclosure

The present disclosure pertains to a wide mouth gusseted package wherein four machine direction edge seals are formed on the film, and the zipper is applied in the transverse direction on the opposite side of the film from where the machine direction edge seals are formed. Additionally, the package may include a peel seal implemented by a sealing strip.

2. Description of the Prior Art

Previous designs of wide open reclosable gusseted packages typically have included pinning the zipper into the four seals thereby resulting in a box-like package which typically is closed in upon itself in the typical side gusseted format. While this has been satisfactory in many respects, further improvements are sought in achieving a crisp looking package.

Similarly, previous designs of wide open reclosable gusseted packages, while satisfactory in many respects, have typically had high production costs in maintaining the necessary alignment and hermeticity.

OBJECTS AND SUMMARY OF THE DISCLOSURE

It is therefore an object of the present disclosure to provide a reclosable wide mouth gusseted package with edge seals which has an improved appearance.

It is therefore a further object of the present disclosure to provide a reclosable wide mouth gusseted package which can be closed outwardly or inwardly.

It is therefore a further object of the present disclosure to provide for hermetic reclosable wide mouth gusseted packages at reduced production costs.

This and other objects are attained by applying a unisex zipper in the transverse direction across a film to form a side gusseted bag thereby resulting in a closure within the circumference of a gusseted bag. First, the edge seals are applied to the film in the machine direction. This can be done prior to the filling/forming tube via different methods or, alternatively, this can be done with film that is already converted with edge seals and/or a zipper. Then, if not already provided, the zipper is applied in the transverse direction.

Moreover, the resulting bag can be made to be hermetic with a seal strip including a layer of sealant and a layer of peel seal material.

BRIEF DESCRIPTION OF THE DRAWINGS

Further objects and advantages of the invention will become apparent from the following description and from the accompanying drawing, wherein:

FIG. 4 is a cross-sectional view further illustrating the formation of the gusseted package.

FIG. 5 is a cross-sectional view showing the edges of the film being brought together.

FIG. 6 is a cross-sectional view of the resulting gusseted package, looking into the open package.

DETAILED DESCRIPTION OF THE PREFERRED EMBODIMENTS

Figure 1:
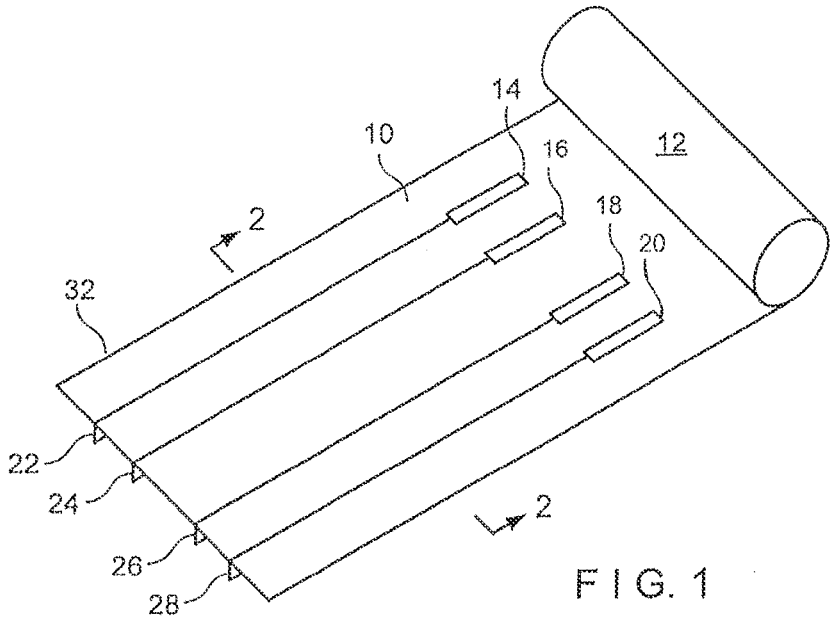
FIG. 1 is a perspective drawing illustrating the use of drag sealers to create edge seals in the machine direction.
Figure 2:
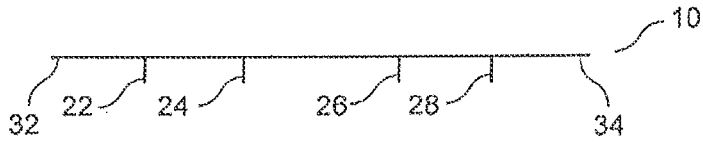
FIG. 2 is a cross-sectional view along plane 2-2 of FIG. 1.
Figure 3:
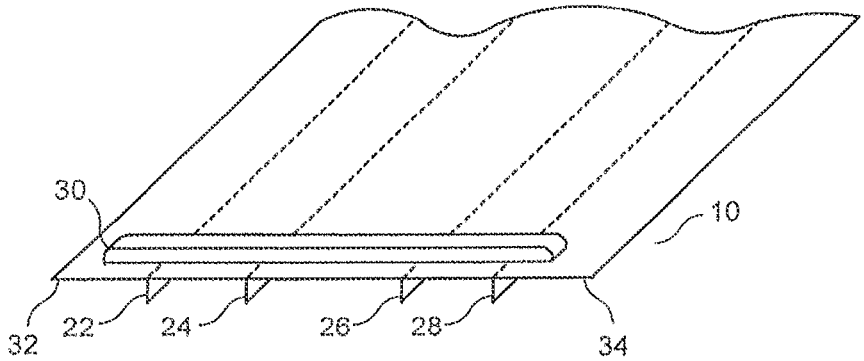
FIG. 3 is a cross-sectional view illustrating the zipper being added in the transverse direction.

Referring now to the drawings in detail wherein like numerals indicate like elements throughout the several views, one sees that in FIG. 1, film or web 10 is provided from a spool or roll 12. Drag sealers 14, 16, 18, 20 (typically with opposed rollers) create machine direction edge seals 22, 24, 26, 28, parallel to each other, in the film 10 as shown in FIG. 2. As will be illustrated hereinafter, the edge seals 22, 24, 26, 28 are intended to be on the four exterior corners of the resulting gusseted bag 100. As shown in FIG. 3, the zipper profile 30, typically a uni-sex or self-mating zipper, in that it can engage with itself, is provided in a transverse direction, along an opposite side of the film 10 from where edge seals 22, 24, 26, 28 are formed. Typically, zipper profile 30 is slightly shorter than the width of film or web 10 thereby leaving longitudinal edges 32, 34 of the film or web 10 free of zipper profile 30.

Figure 7:
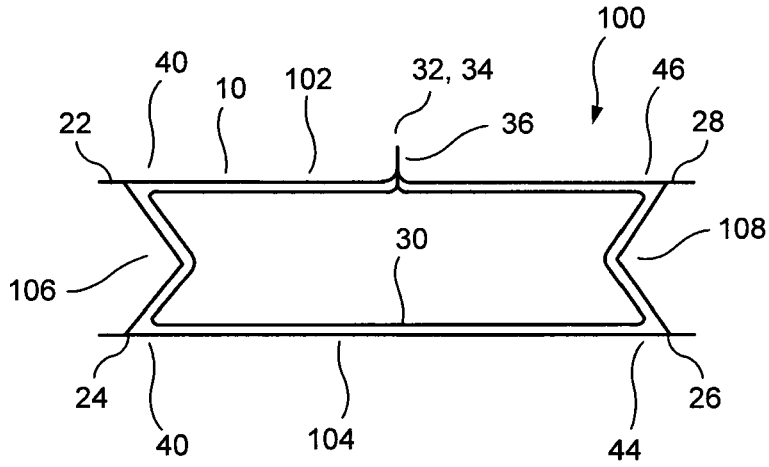
FIG. 7 is a cross-sectional view, showing the inwardly folded position of the gussets.
Figure 8:
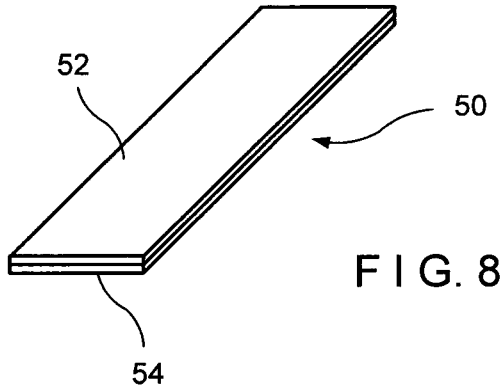
FIG. 8 is a perspective view of a sealing strip with a peel seal layer and a sealant layer, for use with the package of the previous figures.

As shown in FIGS. 4 and 5, the longitudinal edges 32, 34 of film or web 10, oriented in the machine direction, are brought together, typically around a forming tube (not shown) in order to form a fin seal 36 resulting in a package 100, as shown in FIG. 6, with long sides 102, 104 and short sides 106, 108. The zipper profile 30 is on the interior of the package 100, thereby resulting in the appearance of the zipper profile 30 floating on the edge seals 22, 24, 26, 28. It should be noted that the edge seals 22, 24, 26, 28 are on the outer surface of the corners 40, 42, 44, 46 of the package 100. Short sides 106, 108 of package 100 provide gussets which can be closed inwardly (see FIG. 7) or outwardly.

Figure 9:
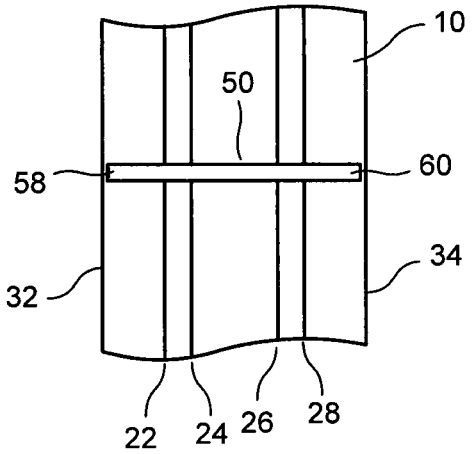
FIG. 9 is a plan view of the sealing strip of FIG. 8 placed across a width of film or web.

FIGS. 8-15 relate to the use of a seal strip 50 in package 100 to achieve hermeticity (alternatively, peel seal film may be used). Seal strip 50 is provided with a layer 52 of peel seal material (illustrated as an upper layer) which is co-extruded, laminated or otherwise formed over a layer 54 of sealant material (illustrated as a lower layer). As illustrated in FIG. 9, seal strip 50 may be laid transversely across a web 10 which includes edge seals 22, 24, 26, 28, similar to FIG. 1. The length of seal strip 50 being slightly less than the width of web or film 10. Therefore, the ends 58, 60 of seal strip 50 terminate inwardly adjacent from the edges 32, 34 of web or film 10.

Figure 10:
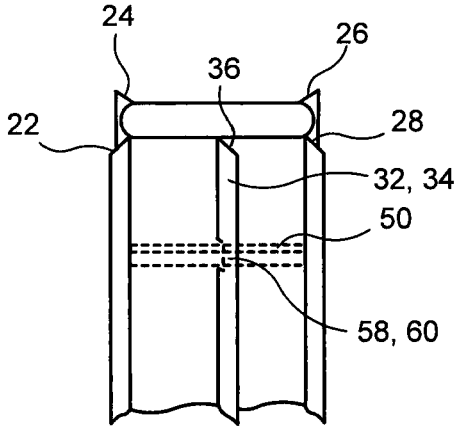
FIG. 10 is a perspective view of the film or web of FIG. 8 being folded so as to form a tube shape for the manufacture of a package.
Figure 11:
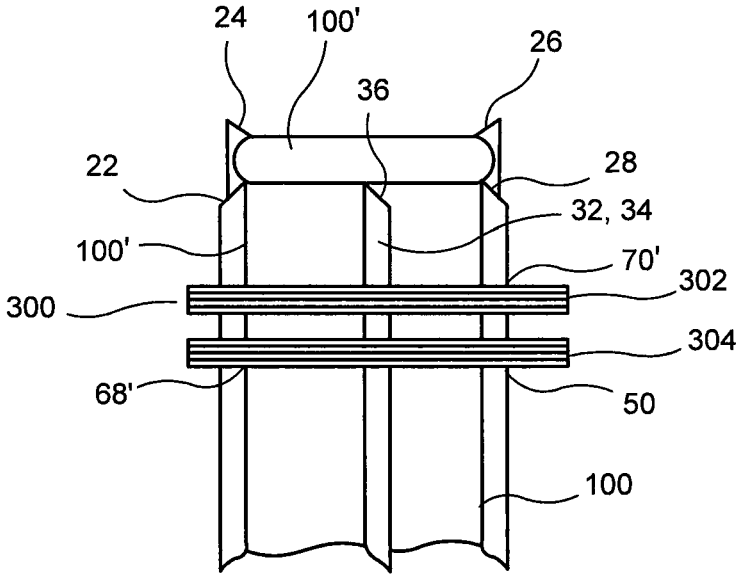
FIG. 11 is a perspective view of sealing bars forming a top seal of a package and the bottom seal of an upwardly adjacent package from the tube of FIG. 9.
Figure 12:
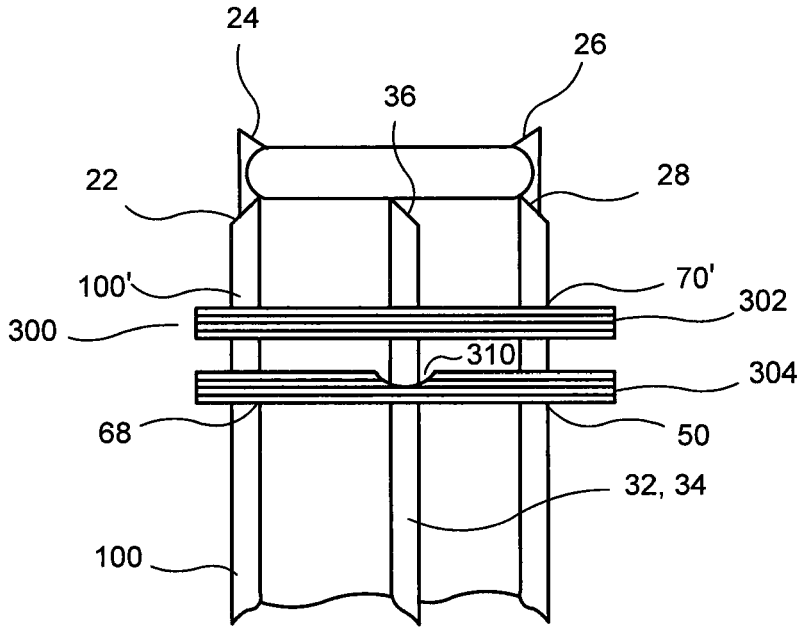
FIG. 12 is a perspective view of an alternative embodiment of seal bars.
Figure 13:
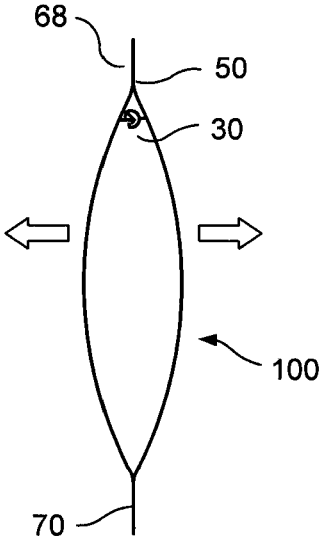
FIGS. 13 and 14 illustrate how the processes of FIGS. 11 and 12 result in a pinch grip package.
Figure 14:
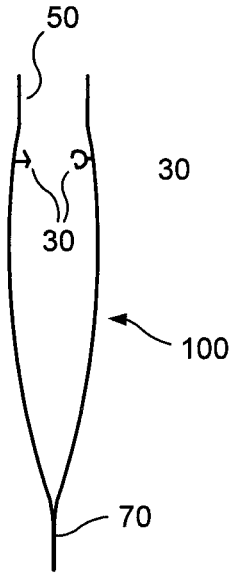

The layer 54 of sealant material is in contact with and is joined to the web or film 10. As shown in FIG. 10, the edges 32, 34 of web or film 10 are brought together and sealed thereby forming fin seal 36 into which the ends 58, 60 of seal strip 50 may extend. While zipper strip 30 is not illustrated in this drawing, zipper strip 30 is typically placed immediately above or below, or may even be combined with seal strip 50. As shown in FIG. 11, a transverse sealer 300 with spaced-apart parallel upper and lower sealing bars 302, 304, typically using thermal, ultrasonic or similar energy, is applied to the web or film 10. The lower sealing bar 304 is configured to be applied to the exterior of web or film 10 so as to engage the seal strip 50 therebetween, thereby bonding or sealing the layer 52 of peel seal material to the web or film 10 and, in some instances, strengthening or completing the seal (if not already completed) between the web or film 10 and the layer 54 of sealant material and forming upper seal 68 of package 10. The upper sealing bar 306 is configured to be applied to the exterior of web or film 10 without engaging the seal strip 50 therebetween, thereby sealing opposing sections of web or film 10 together and forming the bottom seal 70' of an upwardly adjacent package 100'. This configuration is particularly adaptable to form fill and seal configurations wherein the package 100 is tilled after the bottom seal 70' is formed but before the sealing of the seal strip 50 occurs. FIG. 12 illustrates that a notch 310 can be formed in lower seal bar 30 so that the fin seal 36 is not sealed back onto web or film 10, thereby allowing user to open the package 100 by pulling on the fin seal 36. FIGS. 13 and 14 illustrate how the package 10 formed by the process of either FIG. 11 or 12, with zipper strip 30 placed below the peel strip 50, can be opened in a pinch grip operation. The user pulls apart the opposing, walls of FIG. 13, thereby opening or releasing upper seal 68 formed by the layer 52 of peel seal material on seal strip 50 and thereby separating the zipper strip 30 and opening the package 100.

Figure 15:
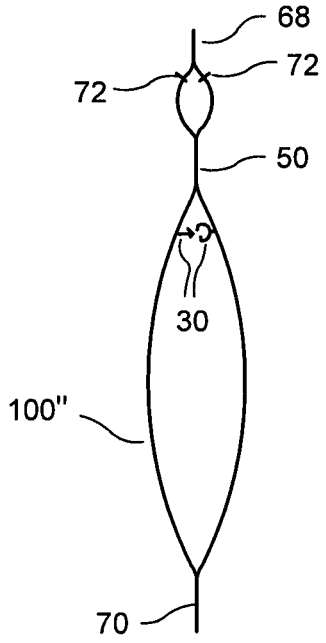
FIG. 15 is a cross-sectional view of an alternative package of the present disclosure.

An alternative package 100" is disclosed in FIG. 15. The seal strip 50 is placed below upper hard seal 68 and lines of weakness 72 (such as, but not limited to, perforations, laser scoring etc.) are formed in the walls of the package 100" between the seal strip 50 and the upper hard seal 68. Zipper strip 30 is placed below the seal strip 50. Therefore, once the user removes the top of the package 100" via the lines of weakness 72, the delamination film of the seal strip 50 can be peeled apart from the customer side of the package 100".

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A process of forming a package, including the steps of:
providing a sheet of web with a first side and a second side;
forming a plurality of seals on a first side of the web;
after the step of forming a plurality of seals, providing a length of self-mating zipper profile on a second side of the web; and
bringing edges of the sheet of web together and sealing the edges of the sheet of web together thereby forming sides of a package.

2. The process of claim 1 wherein the sheet of web is provided in a machine direction, the seals are oriented in the machine direction, and the length of self-mating zipper profile is provided a direction transverse to the machine direction.

3. The process of claim 2 wherein the seals are parallel to each other.

4. The process of claim 3 wherein the length of zipper profile is shorter than a width of the sheet of web.

5. The process of claim 4 wherein the step of bringing the edges of the sheet of web together results in the zipper being on the interior of the package.

6. The process of claim 5 wherein the step of bringing the edges of the sheet of web together results in the seals being on an exterior of the package.

7. The process of claim 6 wherein the package includes corners and wherein the seals are formed at the exterior of the corners.

8. The process of claim 7 wherein the plurality of seals includes four seals and wherein four corresponding corners are formed on the package.

9. The process of claim 8 wherein the package includes four walls.

10. The process of claim 9 wherein two of the four walls are gusseted walls.

11. The process of claim 10 wherein the gusseted walls can fold inwardly or outwardly.

12. The process of claim 11 the step of bringing the edges of the sheet together includes the step of bring longitudinal edges of the sheet together.

13. The process of claim 12 wherein the sheet of web is polymeric.

14. The process of claim 13 wherein the step of sealing the edges results in a fin seal.

15. The process of claim 14 wherein the step of providing the sheet of web includes providing the sheet of web from a roll.

16. A process of forming a package of claim 6 further including the steps of
providing a sealant strip with a first layer comprising sealant material and a second layer comprising peel seal material;
placing the sealant strip on the sheet of web;
after the step of bringing edges of the sheet of web together, applying a first sealing bar thereby forming a top seal of the package.

17. The process of claim 16 wherein the step of placing the sealant strip on the sheet of web includes placing the sealant material against the sheet of web.

18. The process of claim 17 further including the step of sealing the sealant strip to the sheet of web.

19. The process of claim 18 further including the step of applying a second sealing bar to the sheet of web thereby forming a bottom seal of the package.

* * * * *